United States Patent [19]

Costello et al.

[11] 4,177,861

[45] Dec. 11, 1979

[54] RECUPERATOR STRUCTURE

[75] Inventors: Norman F. Costello; Homer D. Huggins; Stephen S. T. Kao, all of Racine, Wis.

[73] Assignee: Modine Manufacturing Company, Racine, Wis.

[21] Appl. No.: 848,813

[22] Filed: Nov. 7, 1977

[51] Int. Cl.[2] ..... F27D 13/00

[52] U.S. Cl. ..... 165/101; 165/34; 432/179

[58] Field of Search ..... 432/179; 165/101, 34, 165/39

[56] References Cited

U.S. PATENT DOCUMENTS

| | | | |
|---|---|---|---|
| 2,744,733 | 5/1956 | Howes | 165/101 |
| 3,390,719 | 3/1966 | McCallister | 165/101 X |
| 3,999,603 | 12/1976 | Huggins | 165/111 |

*Primary Examiner*—Alan Cohan

*Attorney, Agent, or Firm*—Wegner, Stellman, McCord, Wiles & Wood

[57] ABSTRACT

A recuperator structure for recovering heat values from a hot gas stream comprising exhaust gases from a combustion burner supplied with combustion air for burning a fuel in which a heat exchanger is used for exchanging heat between the hot exhaust gases and the combustion air for preheating the combustion air and including a variable temperature control for selectively restricting the volumetric flow of either the air or the exhaust gases or both through the heat exchanger in order to control the temperature in the heat exchanger.

One of the features of this invention is to provide a recuperator structure for recovering heat values by extracting heat in a heat exchanger from the hot exhaust gases from a combustion burner and using this heat in the exchanger to preheat the combustion air to the burner and including means for controlling the temperature in the heat exchanger by controlling the volumetric flow of either the combustion air or the exhaust gases or both through the heat exchanger.

3 Claims, 6 Drawing Figures

RECUPERATOR STRUCTURE

DESCRIPTION OF THE PREFERRED EMBODIMENTS

Figure 1:
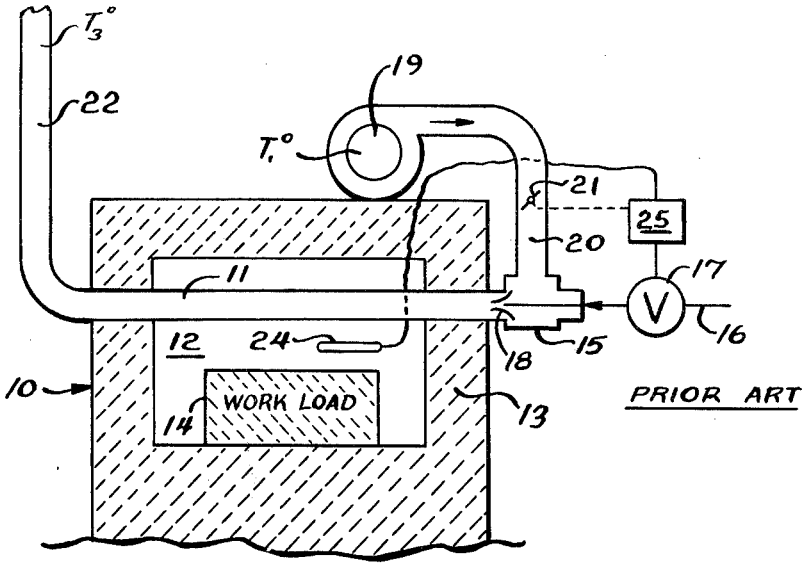
FIG. 1 is a fragmentary vertical sectional view showing semi-schematically a radiant tube heat treating furnace and illustrating the prior art.

FIG. 1 illustrates a prior art radiant tube heat treating furnace 10 comprising a series of radiant tubes 11 of which only one is illustrated for simplicity of illustration used to heat an interior chamber 12 in an insulated housing 13 and in which is located the material to be heated identified as a work load 14.

The radiant tubes 11 are supplied with a combustible gas mixture from a mixing chamber 15 of the customary type supplied with combustible gas through a line 16 with the flow controlled by a variable valve 17.

The mixing chamber 15 which contains a venturi 18 is supplied with combustion air at $T_1°$ from a blower 19 by way of a pipe 20 in which is located a variable flow control shutter or damper 21.

The exhaust combustion gases from the tubes 11 are directed to exhaust by way of a pipe 22. These exhaust gases from the pipe 22 are at a relatively high temperature and the embodiment of FIG. 2 illustrates a recuperator arrangement in which some of this heat is recovered to preheat the air from the blower 19.

Figure 2:
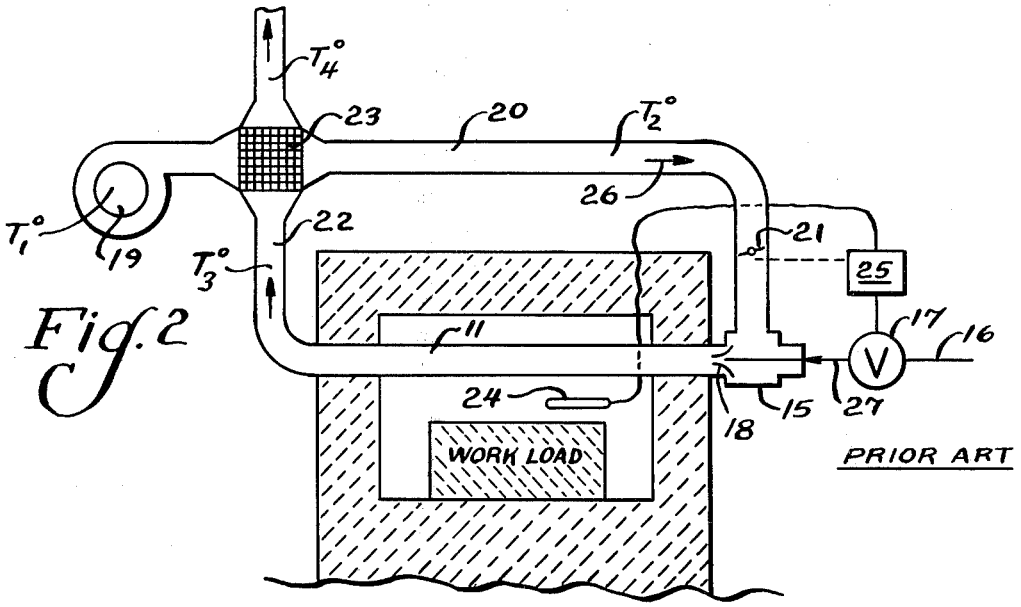
FIG. 2 is a view similar to FIG. 1 illustrating a heat recuperator furnace in which the exhaust gases are used to preheat the incoming combustion air and also illustrating the prior art.
Figure 3:
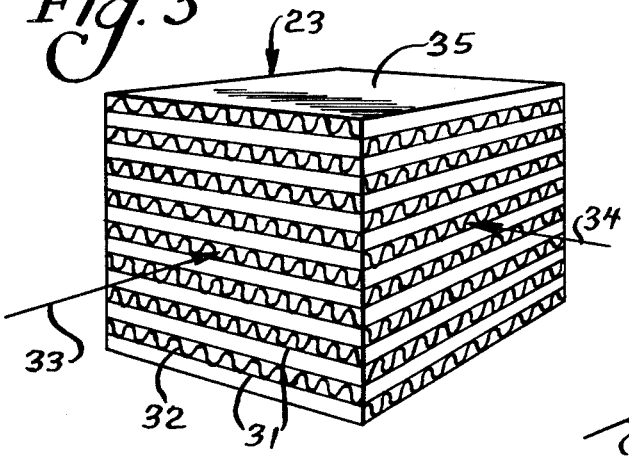
FIG. 3 is a perspective view of a heat exchanger embodiment usable in the structure of FIG. 2.

Both FIGS. 1 and 2 illustrate the prior art. The recuperator structure of FIG. 2 utilizes a heat exchanger 23 for using heat from the exhaust gases in the pipe 22 to preheat the air from the blower 19 to an elevated temperature before it reaches the mixing chamber 15. Thus in this embodiment of the prior art the air temperature which initially is at $T_1°$ becomes heated through this heat exchange to $T_2°$ before entering the mixing chamber 15 for mixing with the gas from the line 16 for burning in the radiant tubes 11.

The exhaust gases from the tubes 11 therefore pass into the heat exchanger 23 through the pipe 22 at a temperature of $T_3°$ which temperature is used to preheat the air to the temperature $T_2°$.

For maximum conservation and extraction of waste heat the combustion air from the blower 19 is preheated to as high a temperature as possible because the higher the temperature to which the combustion air is heated the less gas is needed to heat up the combustion air to the combustion temperature. Thus when a heat exchanger 23 is introduced the exhaust gas in the pipe 22 gives up much of its heat to the air 26 and is reduced to temperature $T_4°$, thereby increasing the overall efficiency of the furnace. This is illustrated in FIG. 2. However, certain problems occur: The principal problem is that as the temperature sensing element 24 normally used and illustrated in both FIGS. 1 and 2 operates the controller 25 to regulate the gas valve 17 and the damper 21 in the gas line 16 and air supply pipe 20, respectively, the combustion air temperature $T_2°$ to pipe 20 tends to increase rapidly to too high a value. This is true because at the lower volumetric flow the heat exchanger 23 becomes more effective in exchanging heat between the incoming air 26 and the exhaust gases in the pipe 22.

Although this is a desirable effect the upper limit of the exhaust gas temperature $T_3°$ in exhaust pipe 22 must be limited in order that the materials used in the mixing chamber 15 as well as other parts of the apparatus are not damaged. The inner parts of the mixing structure including the venturi 18 are usually limited to withstand temperatures up to 300°–400° F. Actual practice has shown, however, that the temperature $T_2°$ to which the incoming air is heated may reach as high as 1000° F. or higher if the air flow 26 and gas flow 27 are reduced to very low values by the valve 17 and damper 21.

In order to prevent this excessive temperature of the air 26, the present invention provides a variable feature for reducing the heat transfer capacity in the heat exchanger 23.

FIGS. 3–6 illustrate a typical cross flow heat exchanger of the type illustrated in prior U.S. Pat. Nos. 3,986,549; 3,991,820 and 3,999,603, assigned to the assignee hereof. These heat exchangers are of the fin and plate cross flow construction in which separator plates 31 alternate with serpentine fins 32 and with alternate fin and plate assemblies being disposed at 90° to each other to provide parallel cross flow passages illustrated by the cross flow arrows 33 and 34. The block type heat exchanger 23 as illustrated also includes end plates 35 at each end to provide the necessary end coverings to the heat exchanger.

Figure 4:
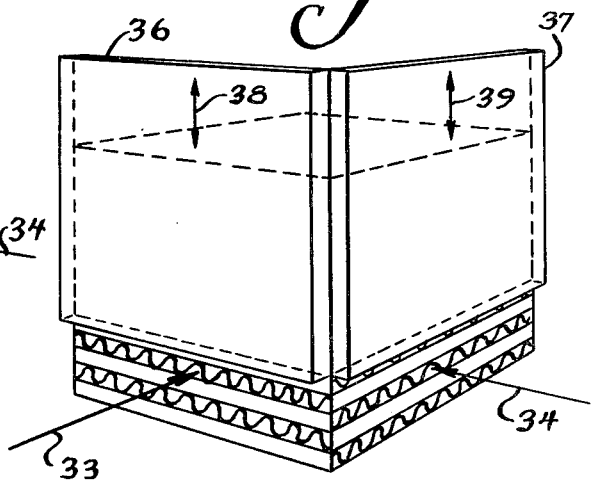
FIG. 4 is a view similar to FIG. 3 but illustrating flow restricting means for the exhaust gases and the combustion air through the heat exchanger of FIG. 2.

In the embodiment of FIG. 4 the variable heat transfer feature is provided by movable side insulating plates 36 and 37 that are movable vertically as illustrated by the arrows 38 and 39 for adjusting the position of these plates to expose the desired cross flow passsages for the flow 33 and 34 of the combustion air and exhaust gases through the heat exchanger.

The pair of plates 36 and 37 cover equal areas of the heat exchanger block so that movement 38 and 39 of these plates to a desired position controls the effectiveness of the heat exchanger by blocking or exposing the desired air and gas passages. The position of these plates 36 and 37 can easily be controlled by the temperature controller 25 and the sensing element 24 which operates this controller.

Figure 5:
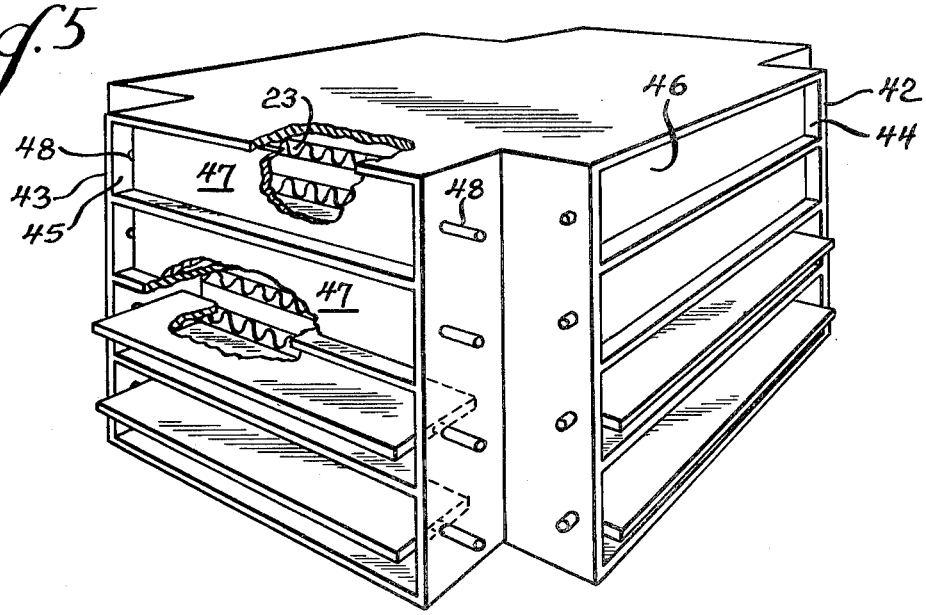
FIG. 5 is a perspective view partially broken away illustrating a second embodiment of the variable heat exchanger.

The second embodiment of this variable capacity heat exchanger is illustrated in FIG. 5. Here the same heat exchanger 23 may be used but the two side faces of the heat exchanger are provided with boxlike extensions 42 and 43 divided by horizontal partitions into separate chambers 44 and 45 in each of which is located a rotatable damper 46 and 47 each of which is rotatable with horizontal axles 48. Adjustable dampers of this type are shown in prior U.S. Pat. Nos. 3,447,443 and 3,604,458, also assigned to the assignee hereof.

In this embodiment the control elements 24 and 25 will modulate these dampers to fully open or fully closed position. For example, if the upper chambers 44 and 45 are closed while the lower three are open the heat exchanger 23 will be operating at 75% of capacity. If half of the dampers on each side were open while the other half were closed the heat exchanger would of course be operating at 50% capacity.

Figure 6:
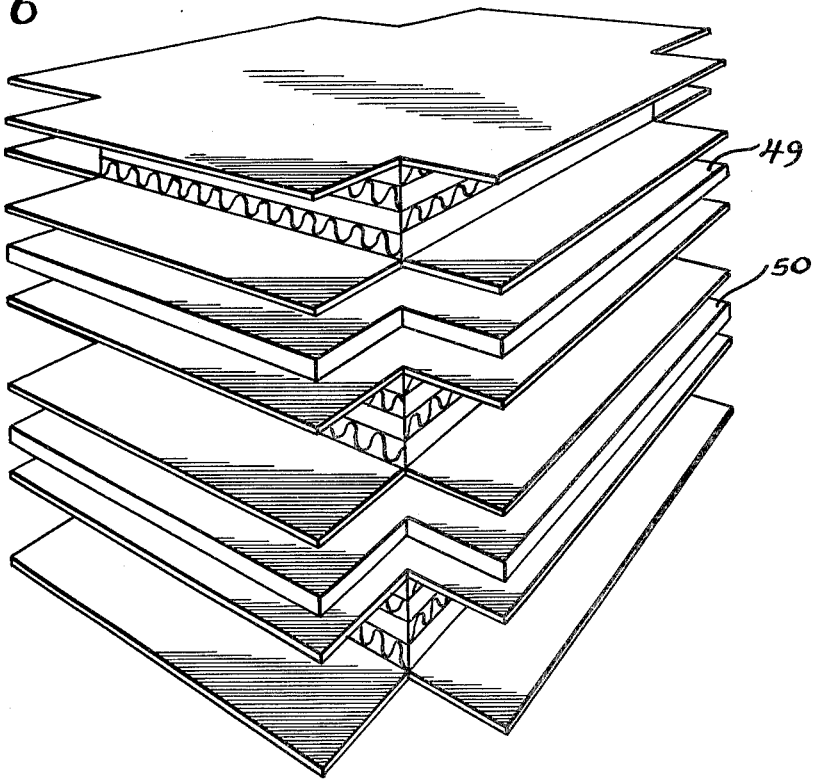
FIG. 6 is an exploded perspective view illustrating a further embodiment of the heat exchanger.

The embodiment of FIG. 6 is very similar to that of FIG. 5 except here the plate and fin heat exchanger sections are arranged in modules between resilient sheets of heat insulation 49 and 50 as shown in the exploded perspective view of FIG. 6. This is desirable particularly in conditions of extreme temperature differences because with certain dampers 47 closed as illustrated in FIG. 5 and others open there would be a tendency for portions of the heat exchanger structure to expand thermally relative to the others which may have a damaging effect of the structure. The providing of the resilient temperature resistant heat insulation 49 and 50 which for example may be a silicone rubber composition nullifies this effect. Otherwise, the embodiment of FIG. 6 is exactly the same as that of FIG. 5.

Having described our invention as related to the embodiments shown in the accompanying drawings, it is our intention that the invention be not limited by any of the details of description, unless otherwise specified, but rather be construed broadly within its spirit and scope as set out in the appended claims.

We claim:

1. Recuperator structure for recovering heat values from a hot gas stream comprising exhaust gases from a combustion burner, comprising: an exhaust gas conduit from said burner; a combustion air conduit to said burner; a heat exchanger having exhaust gas passages in heat transfer relationship with combustion air passages for transferring heat from the exhaust gas to said combustion air; temperature control means for selectively restricting the volumetric flow of at least one of said combustion air and said exhaust gases through the heat exchanger for controlling the temperature in said heat exchanger; means for arranging said heat exchanger exhaust gas passages and combustion air passages in a plurality of modules of the heat exchanger with all modules being positioned in separate passages each controlled by a separate flow control damper; and force yieldable heat insulation means separating each said module from adjacent modules for compensating for thermal dimensional changes and for sealing the gases in the adjacent modules from each other.

2. Recuperator structure for recovering heat values from a hot gas stream comprising exhaust gases from a combustion burner, comprising: and exhaust gas conduit from said burner; a combustion air conduit to said burner; a heat exchanger having exhaust gas passages in heat transfer relationship with combustion air passages for transferring heat from the exhaust gas to said combustion air; temperature control means for restricting said volumetric flow of both said combustion air and exhaust gases in substantially equal volumetric ratios, said heat exchanger comprising a plurality of parallel passages for said exhaust gases and a plurality of parallel passages for said combustion air and said temperature control means comprising a plurality of shutters; means for moving said shutters conjointly for said blocking of desired passages, said combustion burner being part of a heat treating furnace, said temperature control means comprising a temperature sensor exposed to the heat in said furnace; a plurality of temperature control shutters operated by said sensor, said heat exchanger exhaust gas passages and combustion air passages being arranged in a plurality of modules of the heat exchanger with all modules being positioned in separate said passages; a separate flow control damper for each said separate passage; and force yieldable heat insulation means separating each said module from adjacent modules for compensating for thermal dimensional changes and for sealingly separating the gases in the adjacent modules from each other.

3. Recuperator structure for recovering heat values from a hot gas stream comprising exhaust gases from a combustion burner, comprising: an exhaust gas conduit from said burner; a combustion air conduit to said burner; a heat exchanger having exhaust gas passages in heat transfer relationship with combustion air passages for transferring heat from the exhaust gas to said combustion air; and temperature control means for selectively restricting the volumetric flow of both said combustion air and said exhaust gases in substantially equal ratios through the heat exchanger for controlling the temperature in said heat exchanger, said heat exchanger comprising a plurality of parallel passages for said exhaust gases and a plurality of parallel passages for said combustion air and said temperature control means comprising means for blocking desired passages to restrict gas flow therethrough, said temperature control means comprises a plurality of shutters and means for moving said shutters conjointly for said blocking of desired passages, said combustion burner is part of a heat treating furnace, said temperature control means comprises a temperature sensor exposed to the heat in said furnace and there are provided a plurality of temperature control shutters operated by said sensor.

* * * * *